United States Patent [19]

Lawrence

[11] Patent Number: 4,731,884

[45] Date of Patent: Mar. 22, 1988

[54] CLOTHING ARTICLE HAVING MODIFIABLE APPEARANCE

[76] Inventor: Sylvia M. Lawrence, 351 McDonald Ave., Mobile, Ala. 36604

[21] Appl. No.: 7,977

[22] Filed: Jan. 29, 1987

[51] Int. Cl.[4] ..... A41D 1/22

[52] U.S. Cl. ..... 2/72; 2/105; 2/74; 2/243 B

[58] Field of Search ..... 2/105, 72, 74, 76, 70, 2/69, 243 B, 68

[56] References Cited

U.S. PATENT DOCUMENTS

| | | | |
|---|---|---|---|
| 2,696,616 | 12/1954 | Worchester | 2/105 |
| 3,736,596 | 6/1973 | Milne | 2/74 |
| 3,840,899 | 10/1974 | Saxena | 2/74 |

*Primary Examiner*—Doris L. Troutman
*Attorney, Agent, or Firm*—Alexander F. Norcross

[57] ABSTRACT

An article of wearing apparel is constructed having a full conical skirt, a close fitting waist and bodice, and a wide neck strap section, enclosed within a pair of moveable cloth shaping rings. The dress is constructed in three sewn panels of four-way stretchable fabric. The stretch of the fabric, the combination of close fitting bodice and waist and full skirt section, and the manipulation of the strap gathering rings permits the dress to be worn as a strap or strapless dress, as a dress having a crisscross neck or a keyhole neck, with wide or narrow shoulder straps, as a strapless dress or as a pantsuit form. The dress is capable of achieving a multiplicity of appearances.

6 Claims, 15 Drawing Figures

Fig. 3
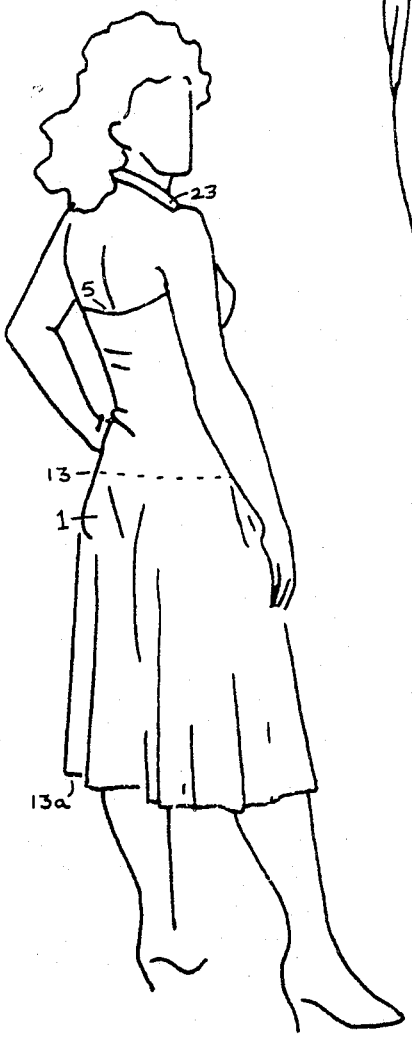
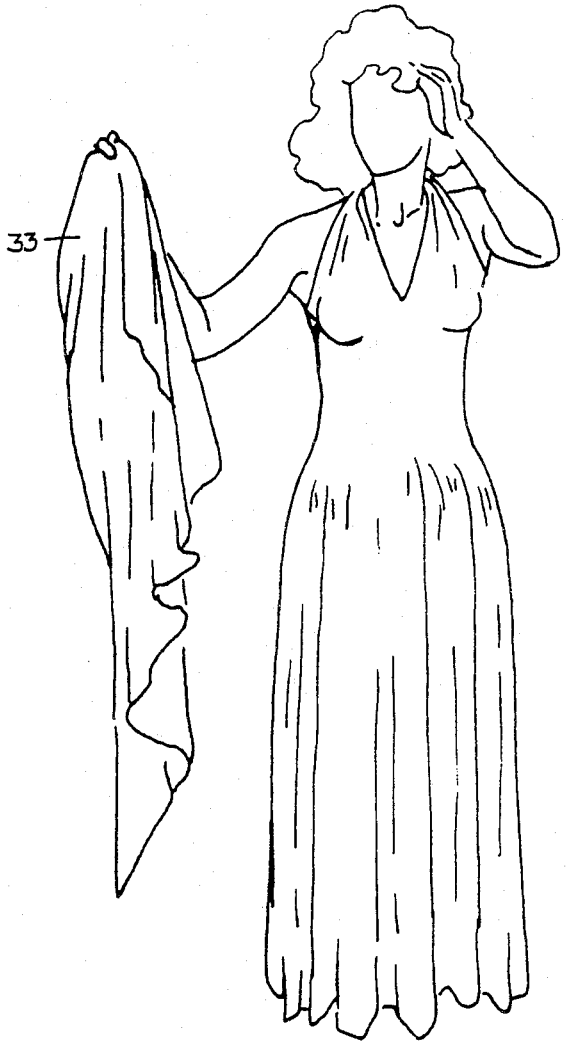
Fig. 2

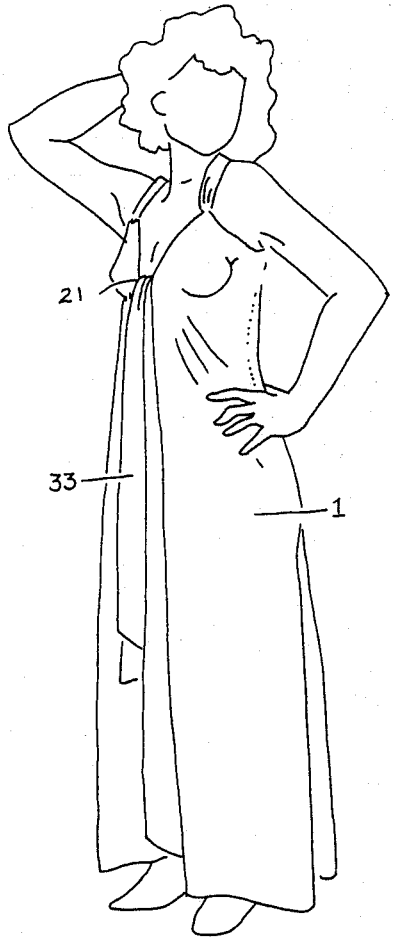
Fig. 8
Fig. 7
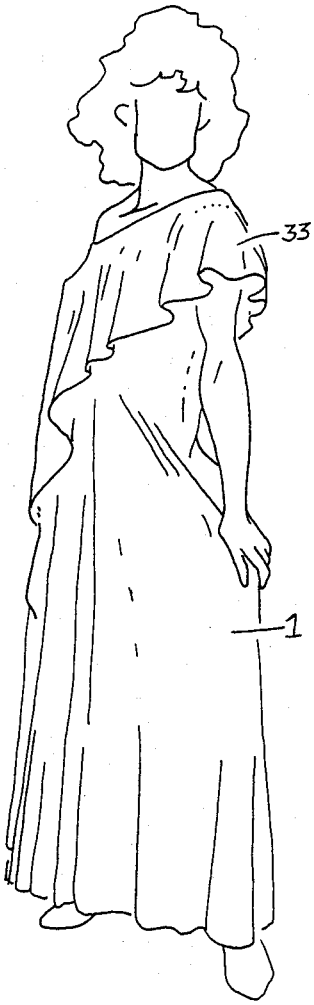

COPYRIGHT 1986 SYLVIA LAWRENCE

CLOTHING ARTICLE HAVING MODIFIABLE APPEARANCE

BACKGROUND OF THE INVENTION

This invention relates to the construction of garments for ladies wearing apparel and to the creation of a garment which can be adjusted in the wearing to provide many, various pleasing external appearances. A single such garment is capable of being adjusted in its wearing so as to appear to be at various times many different garments; the garment is of particular utility in the entertainment and theatrical arts as it permits a few ladies costumes of the described design to be used to produce many different effects. It is equally useful to provide a wardrobe having variable style and appearance, without requiring an extensive personal wardrobe.

The prior art has generally tended to attempt to create multiple styles by providing a plain lower section of the garment and by dividing the upper section so that it may be tied in various positions to produce varying effects. Thus U.S. Pat. No. 4,142,253 to Roscoe discloses a sheath dress having crossed upper triangular tie sections which can be tied by the wearer in various positions to present various appearances. A similar effect may be seen in U.S. Pat. No. 3,877,078 to Tepper showing a two piece body garment in which independent garment pieces are wrapped around the body and then fastened to produce an appearance effect.

U.S. Pat. No. 4,062,062 to Basaldua shows a second form of garment having an essentially tubular or sheath lower portion construction and individual upwardly extending scarf pieces which are prismatic rather than triangular in shape; in use the scarf pieces are wrapped in various forms about the upper body and tied to provide the multiple style effect.

The use of overlying panels of expandable material has also been used to provide articles which may be worn by individuals having varying body sizes. Typical is U.S. Pat. No. 4,343,046 to Zebel showing a plural size fitted article using materials of two different expansion characteristics which are overlapped so as to be moveable with respect to each other, providing a one size fits all effect.

SUMMARY OF THE INVENTION

The current invention discloses a garment preferably of three-piece construction. A back piece comprises a flat topped back section extending downward, expanding in a full arc so as to form a circular lower hem line, sewn along its edge seams to two, symmetrical, mirror image front sections which have matching lower arc pieces to form a full circular skirt and rising through a form fitting waist and bodice section to form a continuous upper neck band section of essentially constant width. The dress obtains its function and unique characteristic by its shape and cut, and by use of a fourway stretchable fabric, that is, a fabric which expands or retracts uniformly with tension along either its warp axis or its woof axis. In addition, the dress provides two, sliding, adjustable rings or gathering bands about the upper neck band section of the garment.

The resulting garment, due to its even flexibility along both its vertical and its horizontal axis of cut, and with use the sliding neck band may be adjusted so as to provide singularly or in combination: a full length full bottom skirt effect, a half length flared bottom skirt effect, or a tucked pantsuit effect; each of these bottom appearances may be individually be combined with an upper bodice which can either be a full neck band, a crossed neck band, or a strapless effect. In addition, the neck strap where shown can be adjusted to be either wide and full or to be narrow depending upon the desires of the wearer.

It is thus an object of this invention to provide a single garment may be adjusted both in its skirt appearance and its upper bodice appearance so as to provide a wider variety of visual effects than those available in the prior art.

It is a further object of this invention to provide a novel dress form permitting the achievement of many upper body appearances whether strapped or strapless.

It is a further object of this invention to provide a single dress garment which can be worn either as a dress, appearing as though it were a skirt, or as a pantsuit.

These and other objects of the invention will be more apparent from the detailed description of the preferred embodiment which follows.

BRIEF DESCRIPTION OF THE DRAWINGS

FIG. 2 is an alternate form of FIG. 1.

FIG. 3 is a view of the garment showing the shortened skirt form.

FIG. 7 shows an off shoulder strapless form of the dress as an evening gown.

FIG. 8 shows an alternate installation of the rough giving a front gathered effect.

DETAILED DESCRIPTION OF THE PREFERRED EMBODIMENT

Figure 1:
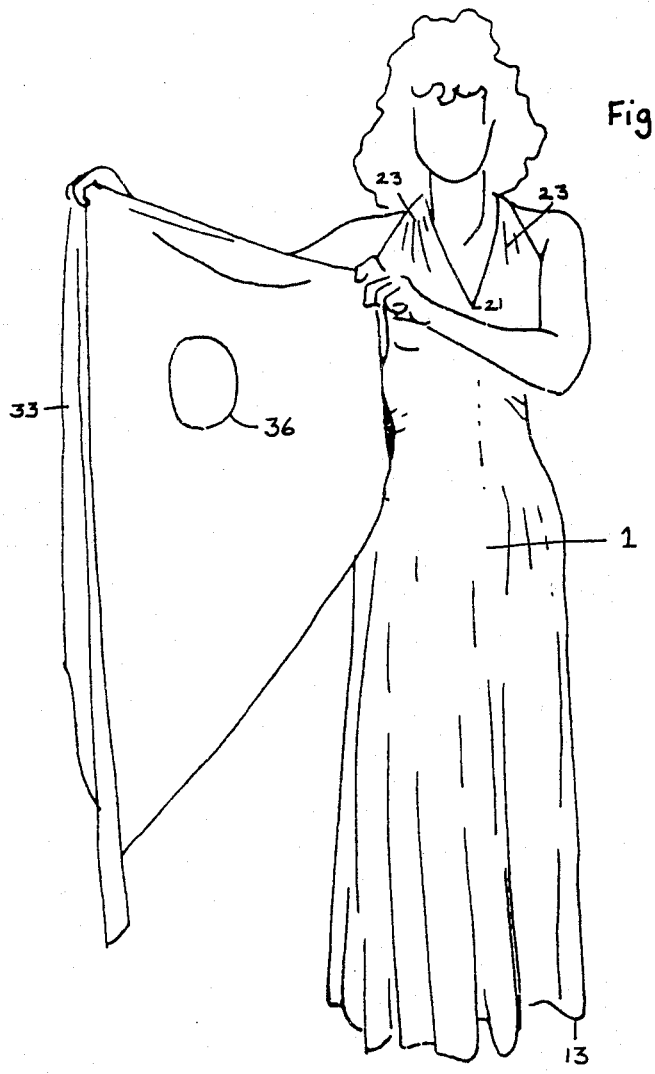
FIG. 1 is a frontal view of the garment as worn showing an optional teardrop adapter.

In FIG. 1 the most general aspect of the garment worn may be seen in frontal view.

Figure 11:
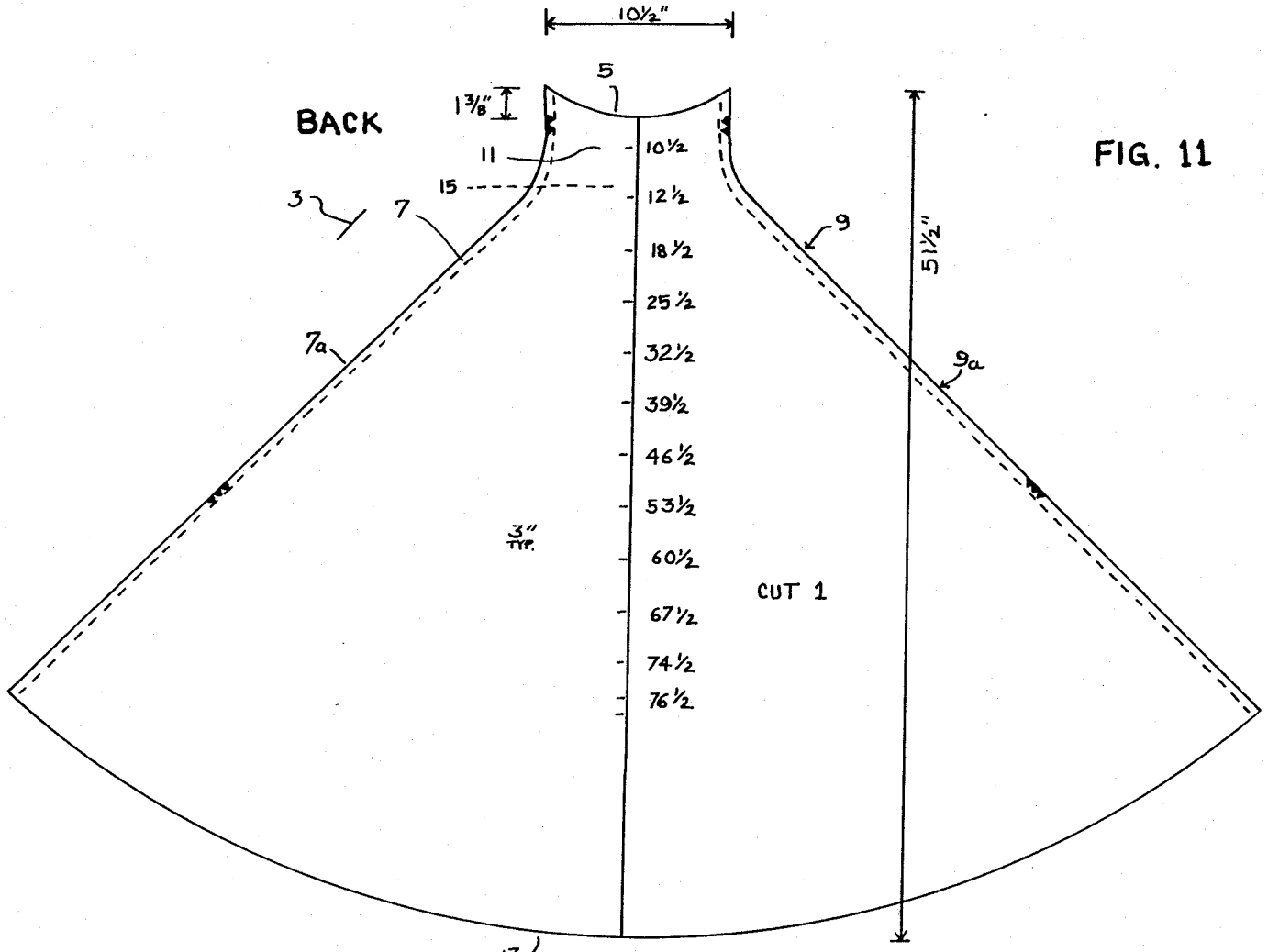
FIG. 11 shows a typical back view pattern of the back section of the garment.
Figure 12:
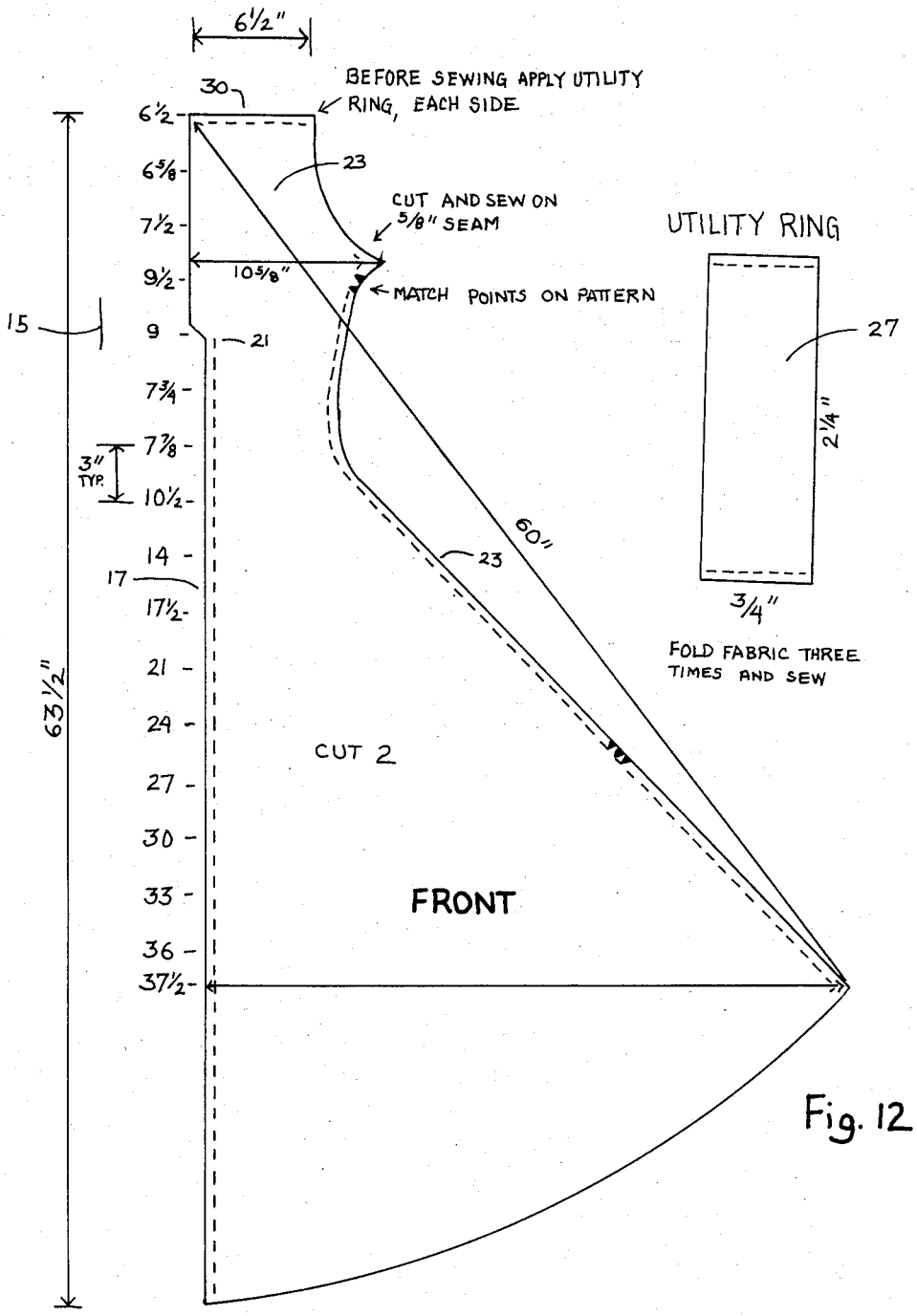
FIG. 12 shows a typical front panel for the garment.
Figure 13:
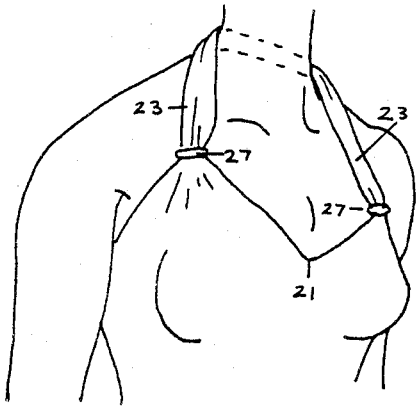
FIG. 13 shows a detail of the neck band adjusted for a narrow effect.
Figure 14:
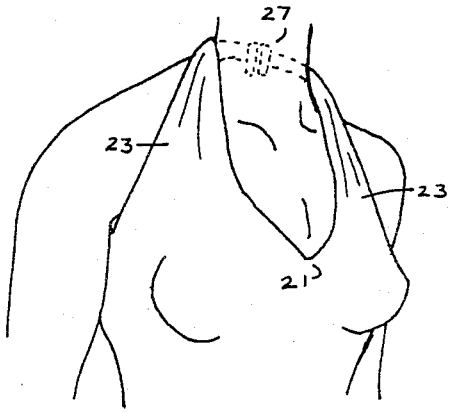
FIG. 14 shows a detail of the neck band adjusted for a wide effect.

Referring to FIGS. 11 and 12 the garment may be seen to comprise a first back section 3 descending from an upper back seam area 5, which defines the upper line of the dress on the back of the wearer. A symmetrical left side seam 7 and right side seam 9 descend for a first straight distance defining a fitted back zone 11 and then a second flair distance outward to form an expanded left side seam 7*a* and expanded right side seam 9*a*, each of which define the overall length of the garment worn, and which, in flat section as cut, are substantially radial lines defining circular bottom hem 13. It can thus be seen that the general shape of the back of the garment is of an upper fitted bodice area, expanding at a definable waist 15 in a smooth flared circular shape.

Matching to and adapted to fit with back section 3 of the garment, are two mating front sections 15, one of which is shown typically in FIG. 12 and the other of which would obviously be a mirror image along the front axis of the shown section.

Two such front sections 15 forming a left and a right front section adjoin and are affixed along front seam 17 which extends from front circular bottom hem 13 to neck line 21. Extending above neck line 21 for a distance adaptable to the wearer are neck strap sections 23 which are of substantially constant width, being expanded solely as required to match and fit along back seam 25 which is affixed by sewing with left side seam 7 or right side seam 9 as appropriate.

Each neck strap 23 is gathered within a matching cloth utility ring 27 before being sewn, left side to right side along upper neck strap seam 30. It can thus be seen that this produces two cloth gathering rings which are slidable upon the upper neck strap seam between the area adjacent neck line 21 and upper strap seam 30.

An optional teardrop accessory or ruff 33 is created from an essentially triangular piece of fabric, identical to that use for the dress, having a single waist line hole 36 cut therein slightly off center from the center of the triangular cloth section.

The entire garment including the utility rings and the ruff must be constructed of so-called four-way stretchable fabric, that is, fabric which has essentially equal stretch and contraction under greater or lesser tension along two mutually perpendicular axis, usually along the warp and the woof of the fabric. It is preferable that a heavier weight form of this material be used for the dress as lighter weight forms of the material tend to have an excessively clinging effect which the wearer may find objectionable. A preferred such four-way stretchable material is sold under a trade number of 922 by Vanity Fair as four-way stretch fabric; a lighter form of four-way stretch material is widely available under the trade name Lycra, but may not have sufficient body to be fully desireable to the wearer.

In use the dress may first be worn by sliding the dress onto the body with the strap about the neck and sliding both utility rings 27 to the back of the neck. In this position, shown in FIG. 1 the dress has a long, full formal gown appearance and the widened neck strap sections 23 present a full bodice.

Figure 4:
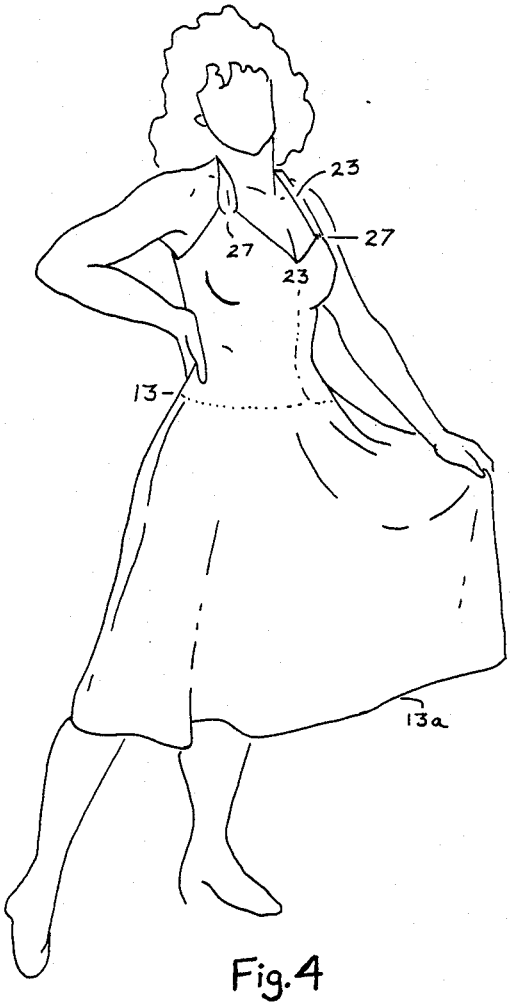
FIG. 4 is a front view of FIG. 3 showing the narrow form of the neck band.

The flexibility of the fabric is such that the dress can be folded inwardly along bottom seam 13, and utility rings 27 slid down adjacent to neck line 21 producing the effect seen in FIGS. 3 and 4 of a short cocktail dress having narrow straps and considerably different bodice appearance.

Alternatively, the dress may be left with skirt extended and ruff adapted 13 placed about the wearer by sliding the adapter over the head through provided hole 36. One form, shown in FIG. 5*a*, the ruff is positioned about the waist and utility rings 27 slid adjacent neck line 21; the difference in contrast and appearance between this and the appearance in FIG. 4 are as though these were two different garments. Again, removing the ruff while leaving garment 1 unchanged as described above produces an aspect different both from that shown in FIG. 5*a* and that shown in FIG. 1.

Figure 6:
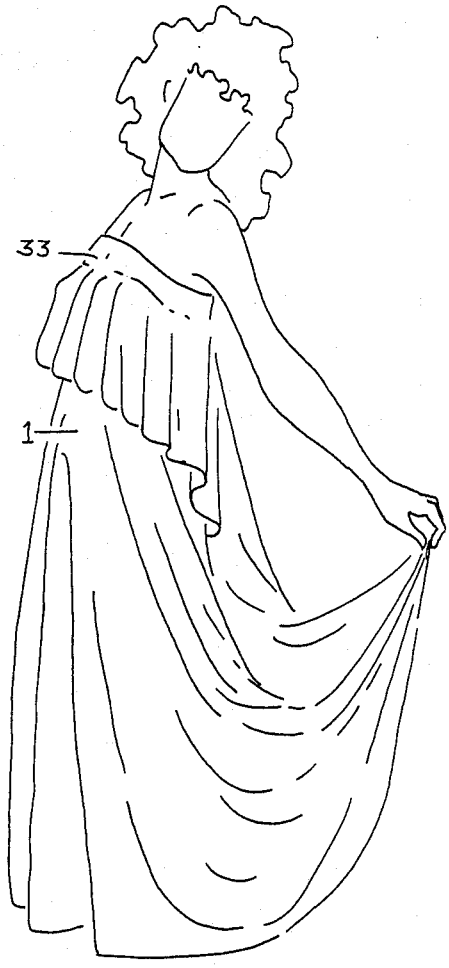
FIG. 6 shows a form of the dress with adapter in the form of a strapless evening gown.

The expandability provided by the combination of fabric and pattern also permits the neck strap section 23, rather than being placed about the neck may be tucked into the bodice. The ruff may then be placed over the garment in the vicinity of the wearer either immediately beneath the shoulder line, as shown in FIG. 6 or off one shoulder as shown in FIG. 7 providing two different, pleasing, strapless gown effects.

Figure 5A:
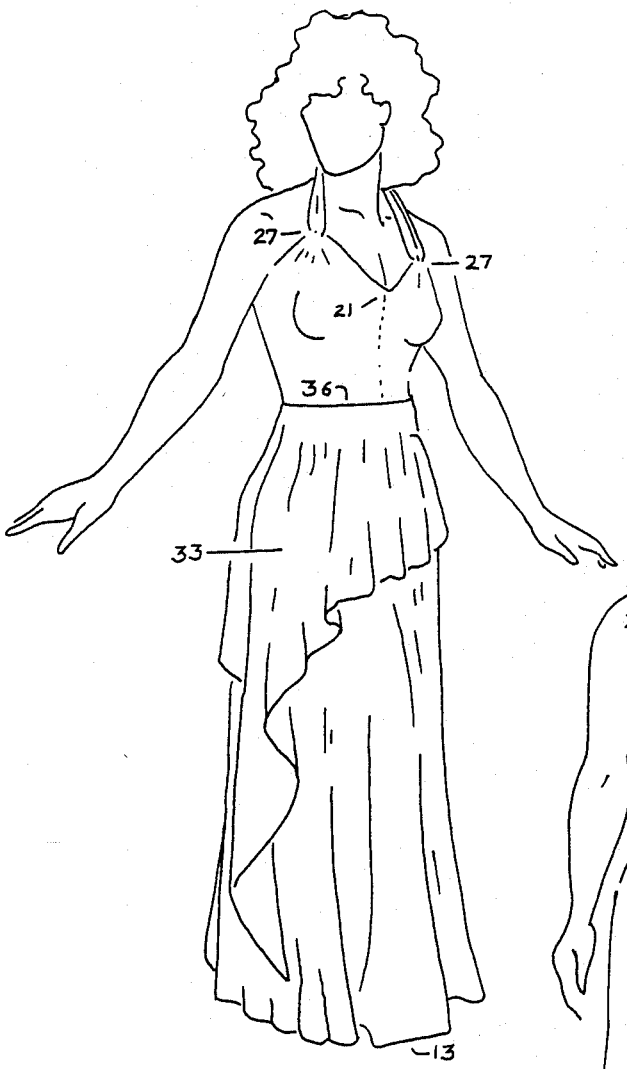
FIG. 5 and FIG. 5*a* are frontal views showing the long formal form of the dress with narrow neck band with and without the adapter.
Figure 5B:
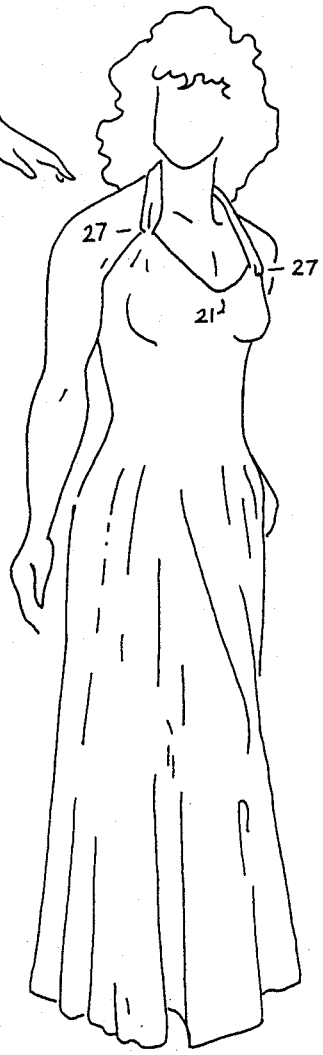

Alternatively, the gown may be adjusted as shown in FIG. 5*a* and then the ruff may be tucked through the neck line, providing a formal gown effect having a gathered and bunched front.

Figure 10:
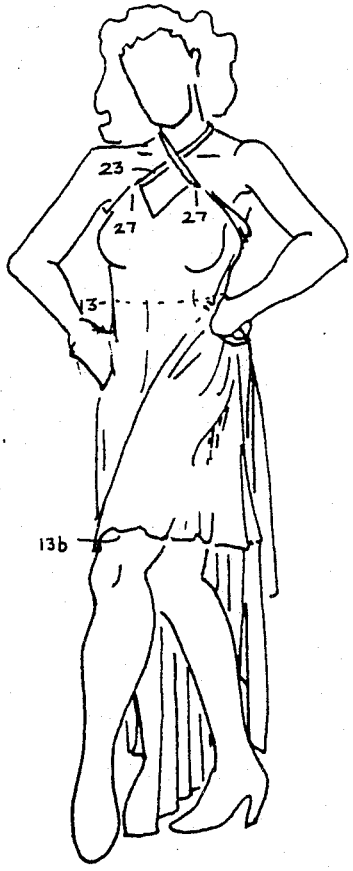
FIG. 10 shows the garment adjusted for shortened skirt and crossed shoulder strap.
Figure 9:
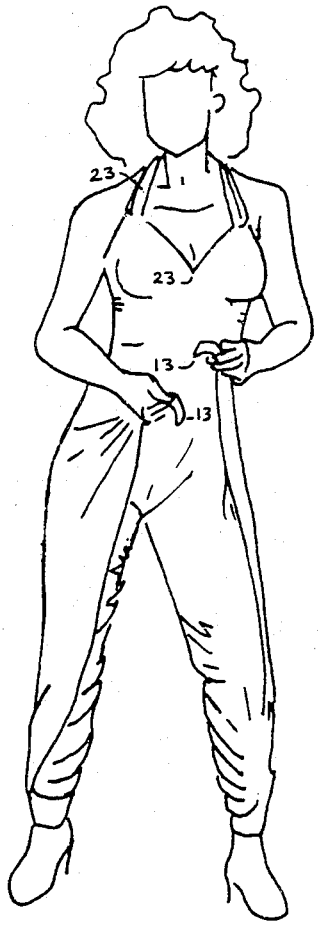
FIG. 9 shows the adaption of the garment as a pantsuit.

The versatility of the described garment worn and the particular combination of pattern and fabric can be seen in FIGS. 9 and 10. The combination of the extremely full skirt and fitted upper portion together with the uniform stretchability of the fabric permits the front section of bottom hem 13 to be gathered pulled through the legs and tucked around the waist forming a pantsuit effect as shown in FIG. 9. Alternatively, the fullness of the skirt and the flexibility of the fabric allow the skirt to be doubled under form a high alternate hem seam 13*b* the original hem being tucked immediately under the bodice. FIG. 10 also shows an alternate effect achievable by crossing neck strap 23 again with lowered utility rings 27 to form a narrow strap.

The specific construction disclosed above, as is obvious to those skilled in the art, is dependent upon the availability of fabric in sufficient widths to make the back section as a single panel, which is preferred. Should lesser widths of fabric be available, it is obvious that the back panel may be constructed as two mating halves in the manner well understood in the art.

It can thus be seen the particular combination of garment cut and design in combination with the fabric and in combination with the use of the shaping strap along the upper neck band section provides a garment having an extremely wide range of achievable appearances.

The described appearances shown as illustrative within this description are not exclusive and additional shapes and appearances can easily be achieved by the imaginative wearer.

Thus the invention is not limited to the specific embodiment described here but rather the general equivalents of that claimed.

I claim:

1. An article of feminine wearing apparel capable of being worn in a plurality of styles, comprising in combination:

a. A generally form fitting structure adapted for enclosing the waist and torso area of a wearer;

b. A full, flared, skirt section, seamlessly continuously depending downward from said torso section, extending to a hem point adjacent the foot of the wearer;

c. A continuous, substantially uniform width neck strap extending from a left front side of said torso section and connecting seamlessly to a right front side of said torso section, forming a continuous loop thereby;

d. Two restriction means slidably enclosing said neck strap section; and e. The entire article being made of a fabric having uniform stretch characteristics along at least two substantially perpendicular directions.

2. An upper section of a feminine dress having modifiable appearance comprising in combination:

a. An essentially form fitting structure for encasing the waist and lower section of the torso of a wearer;

b. A neck band section of uniform width extending, continuously from one front upper side of said section to a second front upper side of said section, forming thereby a loop adapted to be worn about the neck of the wearer;

c. Two restraining means, slidably affixed along said loop, adapted for tightly gathering the said neck band; and d. The entire being constructed of a fabric having uniform stretch characteristics along at least two substantially perpendicular axis.

3. The garment as described in claim 2 above wherein the restraining means further comprise:

a. A first and a second cloth ring, of the uniformly stretching material, forming a ring having an unstretched circumference of less than two and a half inches.

4. The article as described in claim 2 above further comprising:

a. A flared lower skirt section continuously extending downward from said torso section defining a lower circular hem;

b. Said circular hem defining a uniform circular conical radius from an upper point of said loop.

5. A method of construction of the upper section of a feminine dress having variable appearance comprising, in combination:

a. Constructing an essentially form fitting waist and bodice section of a four-way stretchable fabric material;

b. Extending said bodice continuously to form a neck band loop, extending from the upper section of said bodice; and c. Providing two, slidable, gathering rings along said neck band loop.

6. An article as described in claim 1 above further comprising, in combination:

a. A substantially triangular section of a fabric having uniform stretch characteristics along at least two substantially perpendicular directions, being adapted to compressibly enclose the waist of a wearer through a point offset from the center of said triangular section;

b. Being adapted to being compressibly overlaid said article, enclosing said article.

* * * * *